US008087519B2

(12) United States Patent
Bramley et al.

(10) Patent No.: US 8,087,519 B2
(45) Date of Patent: Jan. 3, 2012

(54) DISHWASHER BASKET

(75) Inventors: Alistair Bramley, Brooklyn, NY (US); Tim Connelly, Brooklyn, NY (US); Brook Kennedy, Glen Ridge, NJ (US); Lorcan Geraghty, Yonkers, NY (US)

(73) Assignee: Helen of Troy Limited, St. Michael (BB)

( * ) Notice: Subject to any disclaimer, the term of this patent is extended or adjusted under 35 U.S.C. 154(b) by 49 days.

(21) Appl. No.: 12/455,450

(22) Filed: Jun. 2, 2009

(65) Prior Publication Data

US 2010/0300997 A1 Dec. 2, 2010

(51) Int. Cl.
*A47G 19/08* (2006.01)

(52) U.S. Cl. ..... 211/41.3; 211/41.8; 220/488

(58) Field of Classification Search ..... 211/41.8, 211/41.9, 41.3; 220/520–522, 488, 487, 220/572; 134/135, 166 R
See application file for complete search history.

(56) References Cited

U.S. PATENT DOCUMENTS

| | | | | | |
|---|---|---|---|---|---|
| 1,462,245 | A | | 7/1923 | Reglein | |
| 1,487,942 | A | | 3/1924 | Hines et al. | |
| 2,060,468 | A | * | 11/1936 | Mitchell | 220/676 |
| 2,516,088 | A | | 7/1950 | Einhorn | |
| 2,708,037 | A | | 5/1955 | Planeta | |
| 2,936,066 | A | * | 5/1960 | Meksula | 312/324 |
| 3,643,812 | A | * | 2/1972 | Mander et al. | 211/74 |
| 3,935,958 | A | | 2/1976 | Frangos | |
| D254,187 | S | | 2/1980 | Freese | |
| 4,531,641 | A | | 7/1985 | Archambault | |
| 4,613,041 | A | * | 9/1986 | Carlton | 206/373 |
| 4,732,291 | A | | 3/1988 | McConnell | |
| 4,830,200 | A | | 5/1989 | Zambano et al. | |
| 4,854,537 | A | | 8/1989 | Welch | |
| 4,867,332 | A | * | 9/1989 | Mains | 220/735 |
| 5,069,360 | A | | 12/1991 | Dingler et al. | |
| 5,082,631 | A | * | 1/1992 | Lenmark et al. | 422/102 |
| 5,431,294 | A | | 7/1995 | Stottmann et al. | |
| D391,696 | S | | 3/1998 | Bournay, Jr. et al. | |
| 5,794,797 | A | | 8/1998 | Kuntz | |

(Continued)

FOREIGN PATENT DOCUMENTS

CN 2009-H72491 * 4/2009

OTHER PUBLICATIONS

International Search Report and Written Opinion dated Mar. 23, 2010 re PCT/US2010/022566.

*Primary Examiner* — Korie Chan

(57) ABSTRACT

A dishwasher basket for securing baby bottle and drinking cup components is disclosed. The basket includes multiple compartments, with at least one split compartment serving as a hinged lid for another compartment. The basket first compartment is defined by sidewalls and a bottom wall, and is open at a side opposite the bottom wall, while the split second compartment is attached to a sidewall of the first compartment and is defined by two sub-compartments capable of movement between an open and a closed position, which when either sub-compartment is in a closed position at least a partial cover to the open top end of the first compartment is formed. The two sub-compartments are open on only one side such that as they adjoin when both sub-compartments are in a closed position a single compartment is formed. The basket is stable when either or both sub-compartments is opened as well.

15 Claims, 5 Drawing Sheets

U.S. PATENT DOCUMENTS

| | | | | |
|---|---|---|---|---|
| 6,763,954 | B1 | 7/2004 | Travers et al. | |
| 6,814,091 | B2 | 11/2004 | McConnell et al. | |
| 6,915,808 | B2 | 7/2005 | McConnell et al. | |
| 6,918,508 | B2 | 7/2005 | Hwang | |
| 7,380,686 | B1 | 6/2008 | Friedman et al. | |
| 7,383,846 | B2 * | 6/2008 | Curran | 134/135 |
| 2002/0162838 | A1 | 11/2002 | Leaphart et al. | |
| 2002/0185166 | A1 | 12/2002 | Rosenbauer et al. | |
| 2003/0205258 | A1 | 11/2003 | McConnell et al. | |
| 2006/0065295 | A1 * | 3/2006 | Dunn et al. | 134/135 |
| 2006/0065666 | A1 | 3/2006 | Dunn et al. | |
| 2006/0237051 | A1 * | 10/2006 | Bengston et al. | 134/56 D |
| 2007/0212277 | A1 | 9/2007 | Riley | |
| 2008/0272126 | A1 * | 11/2008 | Crookshanks et al. | 220/486 |

* cited by examiner

DISHWASHER BASKET

TECHNICAL FIELD OF THE INVENTION

The present device relates to baskets used in dishwashing units. Particularly, the present device relates to baskets for securing components from baby bottles and infant cups, such as rings, tops, nipples, caps, straws and the like, for washing in a dishwashing unit.

BACKGROUND OF THE INVENTION

The problem in washing baby-bottle parts, such as bottle rings, caps, and nipples, and infant cup (a.k.a., sippy cups) components in a dishwasher is that the parts are so relatively small and light. If simply positioned on a conventional dishwasher rack, or in an open utensil basket, they would tend to be dislodged and bounce around during the washing, rinsing and drying cycles, thus creating the likelihood of damage to dishes, glasses, the bottle and cup components, and even to the dishwasher itself. Even if undamaged, the parts are less likely to be properly cleaned in a situation where they are allowed to travel about during the dishwashing cycles.

In order to overcome this problem, special racks or baskets have been provided for receiving such bottle and cup parts and for maintaining them segregated from other articles that may be in the dishwasher. At the same time, such baskets prevent the parts from flying about in the dishwasher and causing possible damage to the dishwasher. Multi-compartmented baskets soon came along which allowed segregation of these small components.

Considering that the basket needed to fit within a standard dishwasher, the foot-print size of the basket was important. Too big and valuable dishwasher space would be lost, but too small might inhibit the securing of all the necessary bottle and cup components.

The present invention has provided a solution to each of these problems. By providing a multi-compartmented dishwasher basket with a minimized footprint, but sufficient storage capacity to handle components from baby bottles and infant cups together. There is disclosed herein an improved dishwasher basket which avoids the disadvantages of prior devices while affording additional structural and operating advantages.

SUMMARY OF THE INVENTION

Generally, a dishwasher basket for securing baby bottle and drinking cup components is disclosed and claimed. The basket includes multiple compartments, with at least one split compartment serving as a hinged lid for another compartment.

In one embodiment of the claimed basket the first compartment is defined by sidewalls and a bottom wall, and is open at a side opposite the bottom wall, while the split second compartment is attached to a sidewall of the first compartment and is comprised of two sub-compartments capable of movement between an open and a closed position, which when either sub-compartment is in a closed position at least a partial cover to the open top end of the first compartment is formed. The two sub-compartments are open on only one side such that as they adjoin when both sub-compartments are in a closed position a single compartment is formed.

In an embodiment, the two sub-compartments are independently capable of movement between the open and the closed positions.

In another embodiment, the two sub-compartments are dependently capable of movement between the open and the closed positions.

It is an aspect of an embodiment that the sub-compartments are of an approximately equal size, while in another embodiment the sub-compartments are of unequal size. In either embodiment, it is preferable that the two sub-compartments are attached to the first compartment in a manner such that the basket is stable when either or both of the sub-compartments are in an open position.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
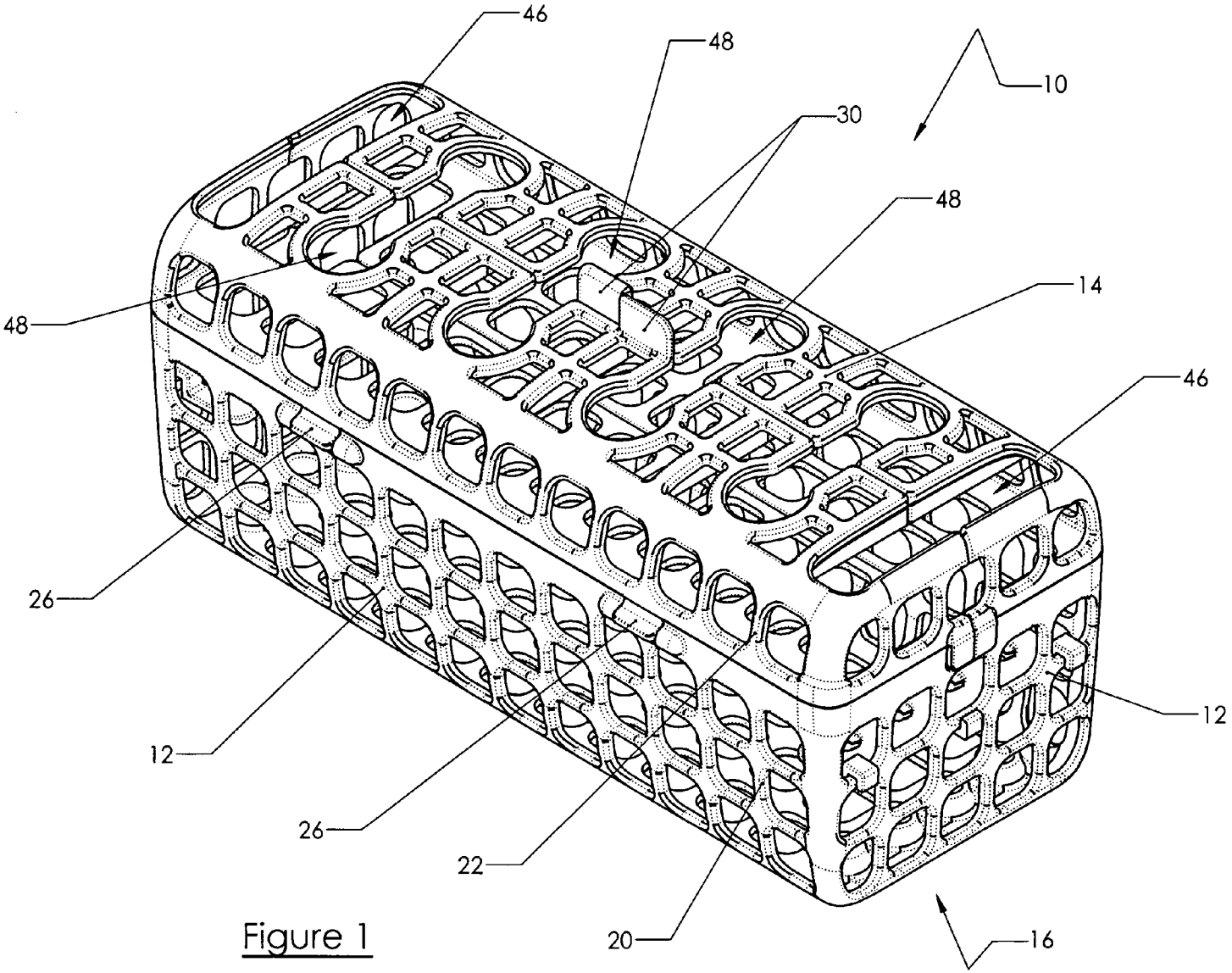
FIG. 1 is a perspective view of an embodiment of the present dishwasher basket.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Referring to FIGS. 1-5, there is illustrated a dishwasher basket, generally designated by the numeral 10. The dishwasher basket 10 is intended to be used to secure the components of both baby bottles and child drink cups, such components including, but not limited to, bottle rings, nipples, caps, bottles, cups, valves, straws, cup lids, etc. Specifically, the basket 10 is intended for use in securing these components during the various cycles of an automated dishwashing machine. However, such components form no part of the claimed invention, though a rudimentary understanding of the components is helpful in understanding the beneficial features of the present invention. Notwithstanding such intended use, the featured dishwasher basket 10 could be readily adapted for any number of uses, including washing other components, for example, or uses not related to dishwashing.

Figure 3:
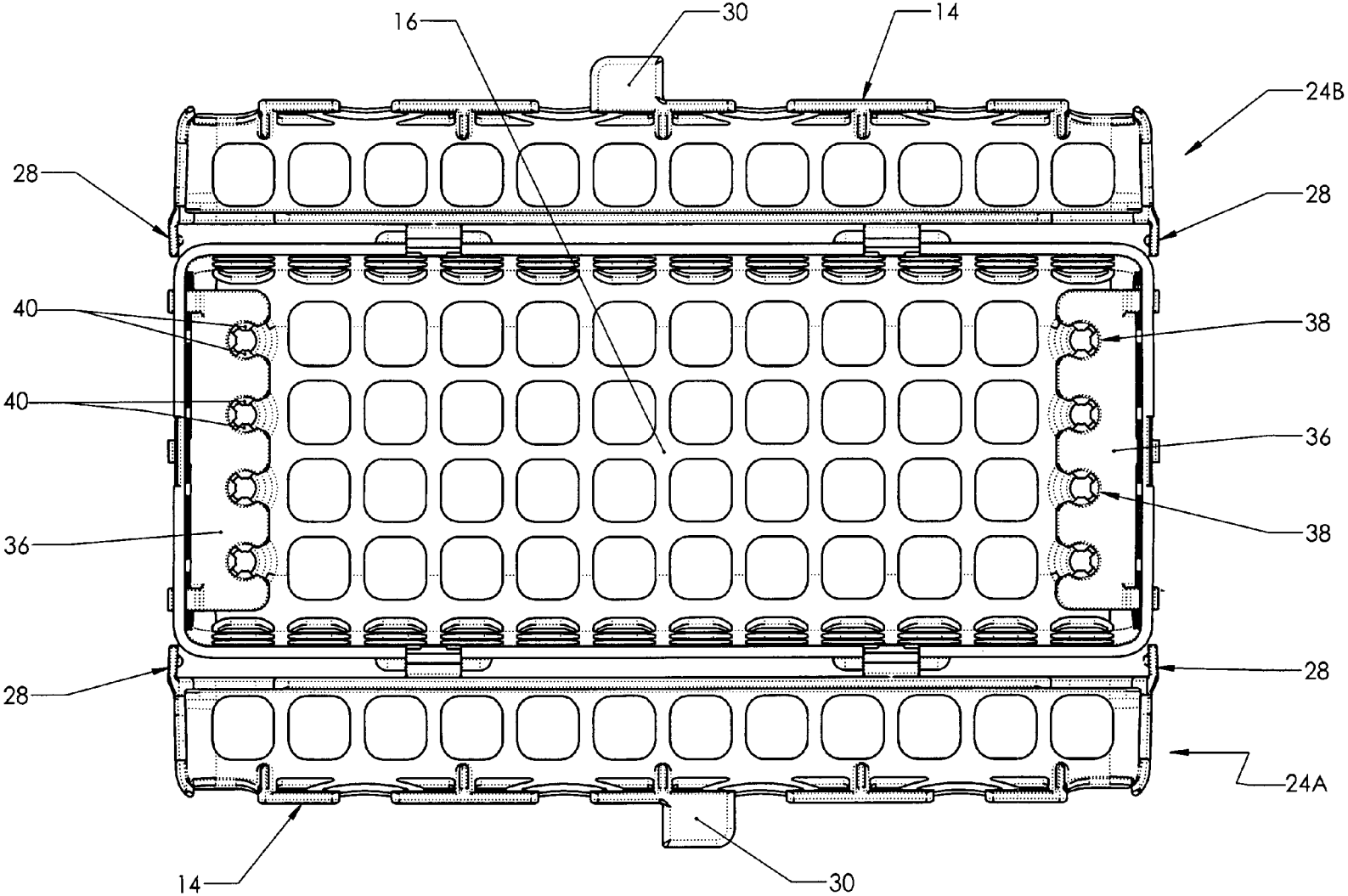
FIG. 3 is a top view of the embodiment of FIG. 2.

FIG. 1 illustrates a rectangular basket 10 having a plurality of openings on all sides, including sidewalls 12, top 14, and bottom 16 (FIG. 3). The holes provide, among the other functions, water access to and drainage from the basket 10 interior during washing. Some of the holes have additional functions, each of which is explained in further detail below. As to the rectangular shape, basket 10 can be configured to have sides in any number of suitable shapes, such as, for example, round (e.g., cylindrical, spherical) or polygonal (e.g., cubic). The desired footprint (i.e., rack space) and any height restrictions of dishwashers are major factors in determining the basket 10 three-dimensional shape.

FIGS. 1-5 illustrate merely a preferred embodiment of the claimed dishwasher basket 10. The dishwasher basket 10 comprises a first compartment 20 defined by sidewalls 12 and a bottom wall 16, and open at a side opposite the bottom wall 16. The first compartment 20 is preferably the bottom compartment on the basket 10. Accordingly, the top of the bottom compartment would be open to allow access. This compartment is generally sized to fit, for example, bottles and cups (not shown).

Figure 2:
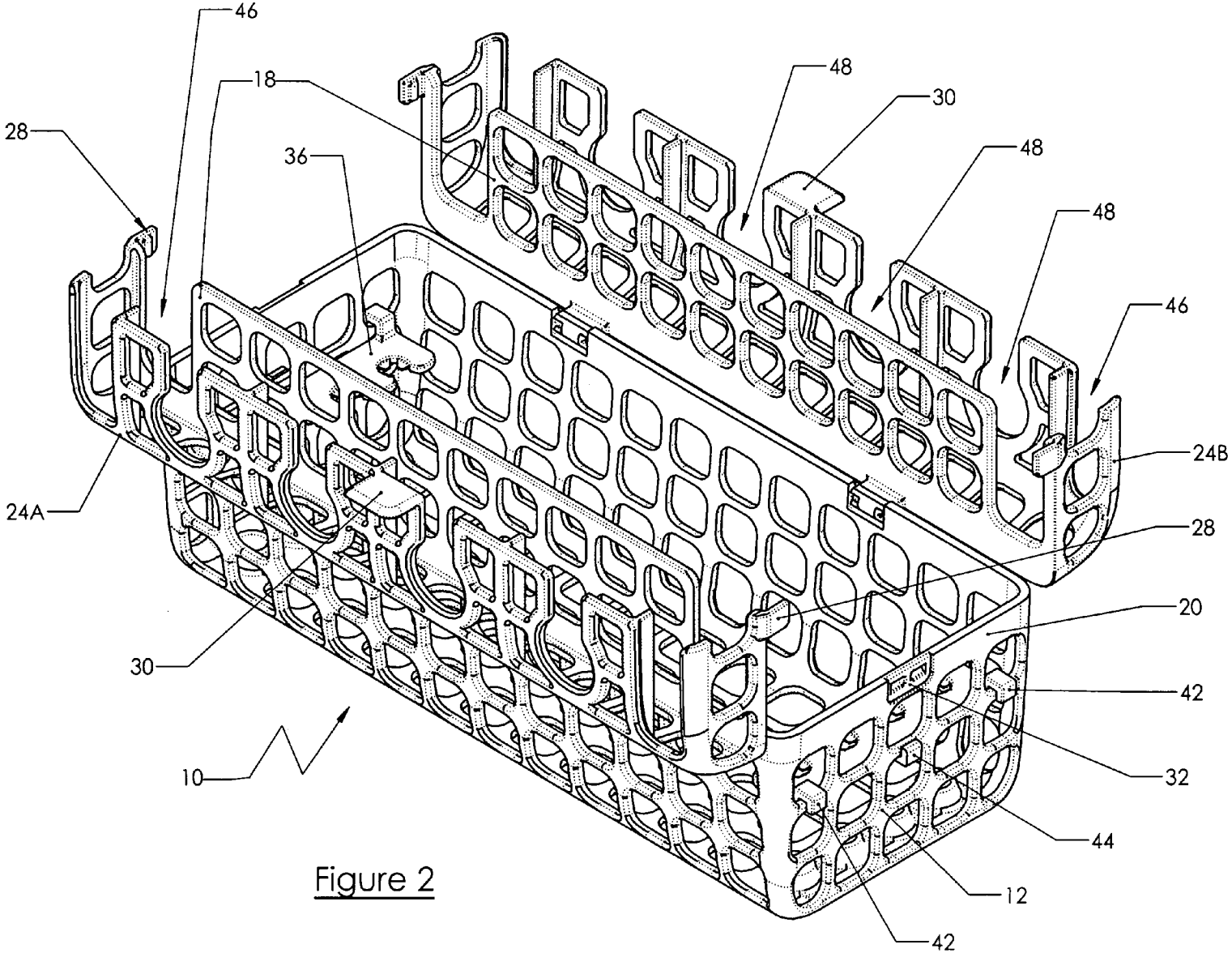
FIG. 2 is a perspective view of the embodiment illustrated in FIG. 1, shown in an open configuration.

The dishwasher basket 10 also comprises a second compartment 22 attached to a sidewall 12 of the first compartment 20. The second compartment 22 is split either longitudinally or laterally and, as a result, comprises two sub-compartments 24A, 24B. As shown in FIG. 1, the second compartment 22 is preferably an upper compartment, relative to the first compartment 20. However, it is possible the two compartments may be configured as side-by-side compartments for certain applications. As shown in FIG. 2, the two sub-compartments 24A, 24B are hinged and capable of movement between an open and a closed position. When either sub-compartment 24A or 24B is in a closed position at least a partial cover to the open top end of the first compartment 20 is formed. When both are in a closed position a complete cover to the open end of the first compartment 20 is formed.

Hinges 26 permit the pivoting movement of the two sub-compartments 24A, 24B. Such hinges may be of any known suitable hinge design, preferably providing sufficient opening to give access to the individual sub-compartments 24A, 24B as well as the interior of first compartment 20.

Additionally, the sub-compartments 24A, 24B may include closing latches 28 and handles 30. The closing latches 28 are positioned along at least one—and preferably both—side edge of each sub-compartment 24A, 24B to engage a corresponding mechanism 32—such as a recess, slot, or the like—on the sidewall 12 of the first compartment 20. The two cooperating components are intended to friction-lock the sub-compartments 24A, 24B in a closed position to prevent opening during a dishwashing cycle. Conversely, the handles 30—one being located on the top of each sub-compartment 24A, 24B—are to allow a user to readily move the two sub-compartments 24A, 24B into an open position. Obviously, a sufficient force would be required to overcome the latching function of the closing latches 28.

Still referring to FIG. 2, the sub-compartments 24A, 24B can be more easily understood. Much like the first compartment 20, each of the two sub-compartments 24A, 24B comprises sidewalls 12, a bottom wall 18, and a top wall 14, and each is open on only one side. The open sides of each sub-compartment 24A, 24B abut one another such that a single compartment is formed when both are in a closed position. When in an open position, the open side faces upward to permit easier access to the interior of the sub-compartments 24A, 24B. The two sub-compartments 24A, 24B are preferably independently operable to be opened and closed, but may be linked such that movement of one operates to open or close both sub-compartments.

While the size of the second compartment 22 is intended to be smaller than the first compartment 20, the relative size of each may vary greatly. In fact, the two compartments may be equal in size. Likewise, the two sub-compartments 24A, 24B are preferably equal halves of the second compartment 22. However, the split may disproportionate with the ratio being in the range of from 25:75 to 50:50.

A key to the split compartment 22 is balance. Many similar devices having a hinged lid will lose stability when such a lid is swung to an open position. The instability can lead to tipping of the basket. The preferred embodiment of the present basket 10 provides increased stability by counter-balancing the two open sub-compartments 24A, 24B against one another. Even where the two sub-compartments 24A, 24B are of unequal size, the split ratio should provide sufficient counter-balance to prevent tipping of the basket 10—loaded or unloaded—when the sub-compartments are opened.

Figure 4:
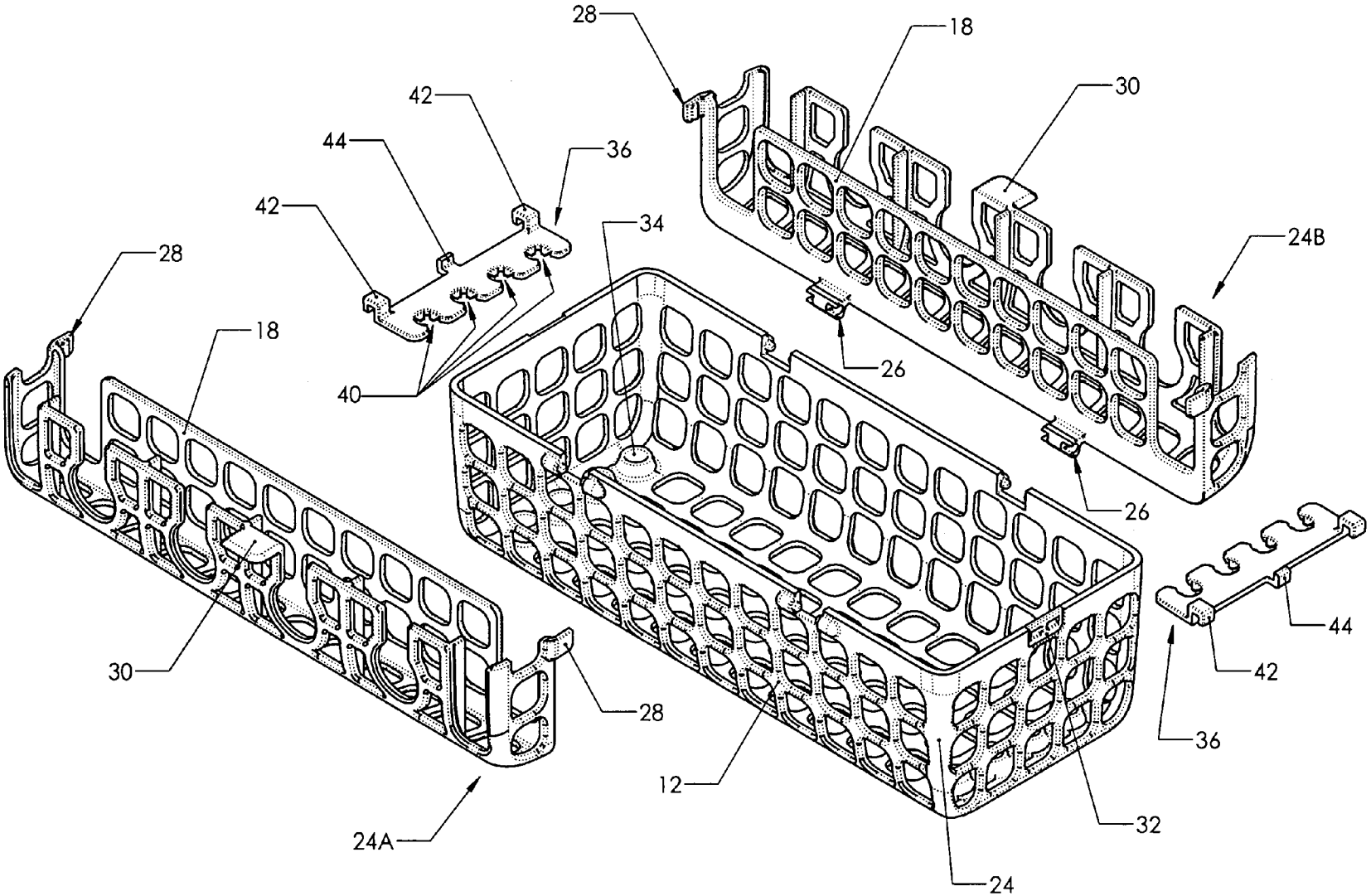
FIG. 4 is an exploded view of an embodiment of the present dishwasher basket.
Figure 5:
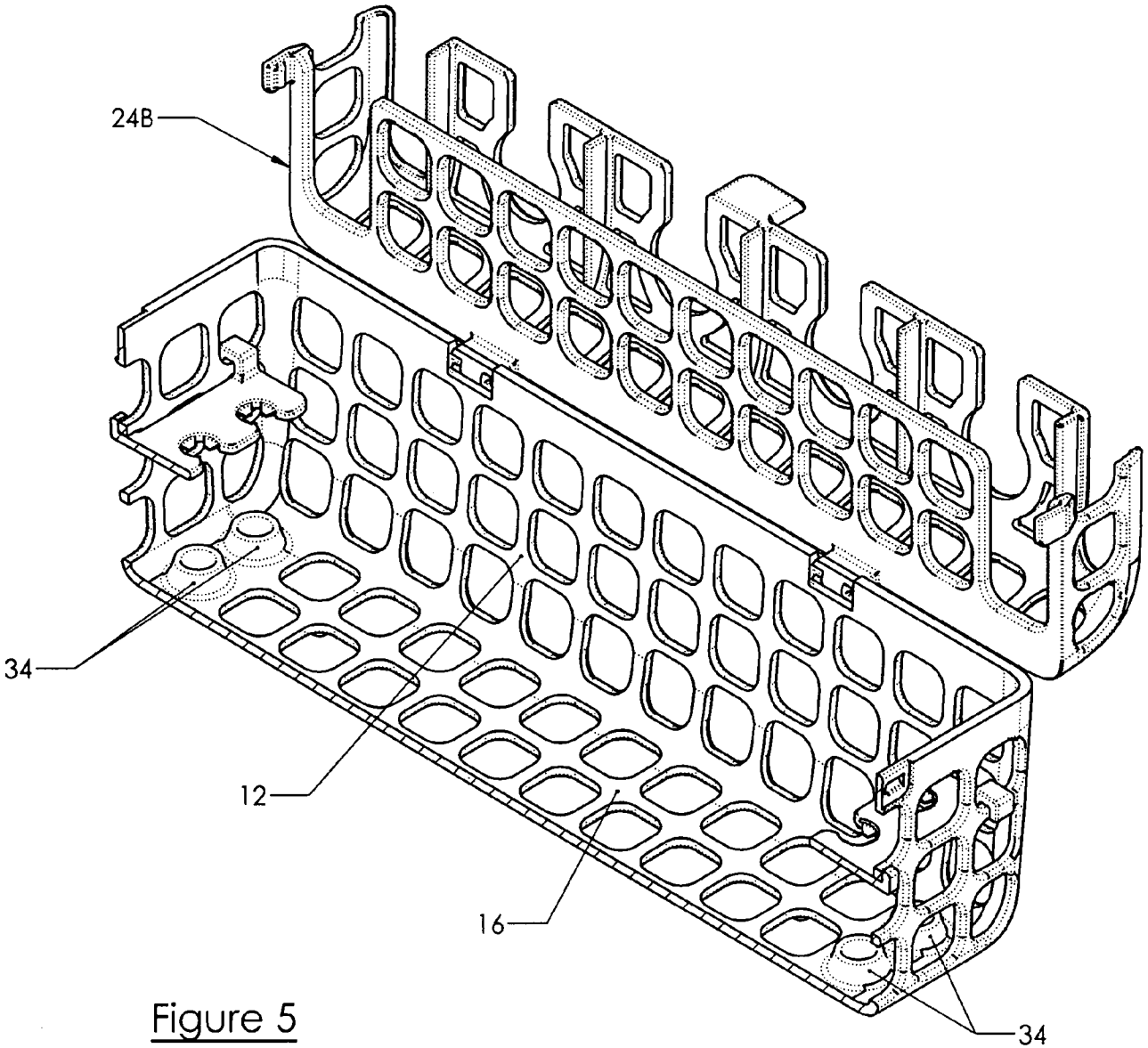
FIG. 5 is a cross-section of the embodiment of FIG. 2, illustrating features on the interior of the dishwasher basket.

Additional features of embodiments of the present basket 10 are shown in FIGS. 3-5. For example, a plurality of straw ports 34 are fixed to a top surface of the bottom wall 16 of the first compartment 20. The ports 34 are designed to retain reusable drink straws (not shown) in a vertical position within the basket 10. The straw ports 34 are integrally molded conical walls formed in the bottom wall 16 of the first compartment 20. Drain holes (not shown) in the bottom of the ports 34 allow water to flow out from a straw or the ports 34.

A straw rack 36 may also be used to provide greater stability to straws during, for example, a wash cycle. The straw rack 36 includes a plurality of retention sites 38 which align with the straw ports 34, as best illustrated in FIG. 3. The retention sites 38 are notched openings to retain straws in a vertical position. Flexible members 40 may be spaced within the retention sites 38 to provide a more affirmative grip of straws.

The straw rack 36 may be detachable (as shown) or an integrally molded component of the first compartment 20. As a detachable component, the straw rack 36 includes end clips 42 which attach through holes in the compartment sidewalls 12. A middle clip 44 is arranged in a direction counter to the end clips 42 to facilitate a secure attachment of the straw rack 36. Naturally, other means exist by which the straw rack 36 may be attached to the compartment sidewall 12. The detachable straw rack 36 gives adjustability to accommodate various straw lengths.

The disclosed dishwasher basket 10 has additional accommodations for securing items therein. Specifically, with reference to the several figures, the bottom wall 18 of the second compartment 22 includes an open area 46 to allow the unencumbered extension of straws (not shown) that may be positioned within the straw ports 34. The top wall 14 of the second compartment 22 may also include such a feature, for accommodation of longer straws. The open area 46 is such that straws may be placed at the straw ports 34 while the two sub-compartments 24A, 24B are in an open position, still allowing the sub-compartments 24A, 24B to close about the straws. Similarly, special openings 48 may be provided in the top wall 14 of the second compartment 22 as a means for retaining bottle nipples (not shown) in place. Each opening 48—four of which are shown in each sub-compartment—is preferably slotted to allow a nipple (or other component) to be slid into position within the open sub-compartments 24A, 24B.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A dishwasher basket comprising:

a first compartment defined by sidewalls and a bottom wall, and being open at a side opposite the bottom wall, the sidewalls and bottom wall including a plurality of openings permitting fluid to pass therethrough; and a split second compartment including a first sub-compartment and a second sub-compartment that are each hingedly attached to at least one of the sidewalls of the first compartment, the first and second sub-compartments each including a front wall, a back wall, a side wall, a top wall and a bottom wall and being adapted to move between an open position and a closed position, wherein the bottom walls of the first and second sub-compartments collectively form a top wall of the first compartment when the second compartment is in the closed position so as to separate the first compartment from the second compartment when the second compartment is in the closed position.

2. The dishwasher basket of claim 1, wherein the two sub-compartments are independently capable of movement between the open and the closed positions.

3. The dishwasher basket of claim 1, wherein the two sub-compartments are dependently capable of movement between the open and the closed positions.

4. The dishwasher basket of claim 1, wherein the sub-compartments are of an approximately equal size.

5. The dishwasher basket of claim 1, wherein the sub-compartments are of unequal size.

6. The dishwasher basket of claim 5, wherein a size ratio of the two sub-compartments to form the second compartment is within the range of from 25:75 to 49:51.

7. The dishwasher basket of claim 1, wherein the two sub-compartments are attached to the first compartment such that the basket is stable when the sub-compartments are in open positions.

8. The dishwasher basket of claim 1, wherein the first storage compartment is larger than the second storage compartment.

9. A dishwasher basket comprising:

a first compartment defined by sidewalls and a bottom wall, and being open at a side opposite the bottom wall; and a split second compartment including two sub-compartments each hingedly attached to a respective sidewall of the first compartment and capable of movement between an open position and a closed position, wherein when either the first or second sub-compartments is in a closed position at least a partial cover to the first compartment is formed, wherein each of the two sub-compartments includes sidewalls, a bottom wall, and a top wall, and each is open on only one side and wherein the open side of each of the two sub-compartments adjoin when both sub-compartments are in a closed position such that a single second compartment is formed, and wherein the bottom walls of the first sub-compartment and the second sub-compartment collectively form a top wall of the first compartment when the second compartment is in the closed position so as to separate the first compartment from the second compartment when the second compartment is in the closed position.

10. A dishwasher basket comprising:

a first compartment defined by sidewalls and a bottom wall, and being open at a side opposite the bottom wall;

a split second compartment attached to a sidewall of the first compartment and comprised of two sub-compartments capable of movement between an open position and a closed position, wherein when either the first or second sub-compartment is in the closed position at least a partial cover to the open top end of the first compartment is formed; and a plurality of straw ports fixed to the bottom wall of the first compartment, wherein the first sub-compartment and the second sub-compartment each includes a front wall, a back wall, a side wall, a top wall and a bottom wall, and wherein the bottom walls of the first sub-compartment and the second sub-compartment collectively form a top wall of the first compartment when the second compartment is in the closed position so as to separate the first compartment from the second compartment when the second compartment is in the closed position.

11. The dishwasher basket of claim 10, further comprising a straw rack attached to a sidewall of the first compartment, wherein the straw rack comprises a plurality of apertures each of which aligns with a straw port.

12. The dishwasher basket of claim 11, wherein the rack is detachable from the sidewall.

13. A dishwasher basket comprising:

a first compartment defined by sidewalls and a bottom wall, and open at a side opposite the bottom wall, the sidewalls and bottom wall including a plurality of openings permitting fluid to pass therethrough; and a split second compartment comprised of two sub-compartments, each of the two sub-compartments being hinged to a sidewall of the first compartment and each being independently capable of movement between an open position and a closed position, wherein when either sub-compartment is in the closed position at least a partial cover to the open top end of the first compartment is formed;

wherein the two sub-compartments are sized such that the basket is stable when either one or both of the sub-compartments are in the open position, wherein the first sub-compartment and the second sub-compartment each include a front wall, a back wall, a side wall, a top wall and a bottom wall, and wherein the bottom walls of the first sub-compartment and the second sub-compartment collectively form a top wall of the first compartment when the second compartment is in the closed position so as to separate the first compartment from the second compartment when the second compartment is in the closed position.

14. The dishwasher basket of claim 13, wherein the two sub-compartments are equally sized.

15. The dishwasher basket of claim 13, wherein the two sub-compartments are unequally sized.

* * * * *